US006501434B1

(12) United States Patent
Hollenstein et al.

(10) Patent No.: US 6,501,434 B1
(45) Date of Patent: Dec. 31, 2002

(54) MULTI-BAND CORRUGATED ANTENNA FEED HORN WITH A HEXAGONAL APERTURE AND ANTENNA ARRAY USING SAME

(75) Inventors: Bruno W. Hollenstein, Santa Clara, CA (US); Ann N. Tulintseff, Seattle, WA (US); Rajan P. Parrikar, Mountain View, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 10/002,808

(22) Filed: Nov. 15, 2001

(51) Int. Cl.[7] ..... H01Q 13/00
(52) U.S. Cl. ..... 343/786; 343/776
(58) Field of Search ..... 343/770, 772, 343/776, 786; H01Q 13/00, 13/02

(56) References Cited

U.S. PATENT DOCUMENTS 3,482,251 A * 12/1969 Bowes ..... 343/786
4,757,324 A * 7/1988 Dhanjal ..... 343/776
5,113,197 A * 5/1992 Luh ..... 343/776
6,137,450 A * 10/2000 Bhattacharyya et al. .... 343/786

* cited by examiner

*Primary Examiner*—Tho Phan
(74) *Attorney, Agent, or Firm*—Kenneth W. Float

(57) ABSTRACT

Feed horn apparatus for use in a multiple-feed antenna system. The present invention comprises a corrugated feed horn and an antenna array or cluster of feed horns arranged in a hexagonal lattice pattern. The feed horn comprises a hexagonal aperture formed by a circular-to-hexagonal transition section a corrugated section disposed adjacent to the circular-to-hexagonal transition section, a tapered section disposed adjacent to the corrugated section, and an input section having an input/output port disposed adjacent to the tapered section. The corrugated feed horn has good beam pattern symmetry, low cross-polarization, and sidelobe levels, along with an increased horn aperture area. As a result, the efficiency of the corrugated feed horn is improved by transitioning from a circular to the hexagonal aperture.

6 Claims, 2 Drawing Sheets

MULTI-BAND CORRUGATED ANTENNA FEED HORN WITH A HEXAGONAL APERTURE AND ANTENNA ARRAY USING SAME

BACKGROUND

The present invention relates generally to satellites, and more particularly, to a multi-band, corrugated antenna feed horn having a hexagonal aperture, and an antenna array employing multiple such feed horns arranged in a hexagonal lattice, for example, for use in a multiple beam antenna system.

The assignee of the present invention manufactures and deploys satellites that orbit the earth and which carry communication equipment, including antenna systems, and the like. The assignee of the present invention has heretofore developed a multi-band, conical corrugated horn with a smooth-wall conical transition to a circular aperture that increases the aperture efficiency of the horn. The present invention relates to hexagonal feed horn structures for use in antenna systems on satellites and other spaceborne vehicles, and provides for an improvement over this previously-developed feed horn structure.

Prior art relating to hexagonal horns addresses a circular feed end, a "flared" horn portion, and a larger, hexagonal aperture end. Other prior art includes conical, corrugated horns with circular apertures.

Prior art relating to hexagonal horns includes U.S. Pat. No. 4,757,324, entitled "Antenna array with hexagonal horn," which describes the use of "flared" horns with a hexagonal aperture and a circular waveguide input. U.S. Pat. No. 5,113,197, entitled "Conformal aperture feed array for multiple beam antenna," discusses a multiple beam array antenna that is designed with an aperture shape which conforms to the particular coverage area to which the antenna is directed, e.g., circular, elliptical, or irregular in shape. The inner horns of the feed array have hexagonal aperture dimensions, while the outer perimeter of the outer horns consist of "arcs" so that the overall feed array perimeter "matches" the shape of the coverage area. There are numerous, prior conical corrugated antenna feed horns developed by the assignee of the present invention that have the last, circular corrugated ring as the aperture (i.e., no smooth-wall conical transition to larger circular aperture).

It is an objective of the present invention to provide for a feed horn that improves the radiation pattern symmetry, low cross-polarization levels, and bandwidth of hexagonal feed horn structures. It is also an objective of the present invention to provide for a multi-band, corrugated antenna feed horn having a hexagonal aperture to improve efficiency. It is also an objective of the present invention to provide for an antenna array employing multiple hexagonal aperture feed horns.

SUMMARY OF THE INVENTION

To meet the above and other objectives, the present invention provides for feed horn apparatus comprising a multi-band, corrugated antenna feed horn that may be used in a multiple-feed antenna system. Multiple such multi-band, corrugated antenna feed horns may be arranged to form a corrugated feed horn array or cluster of feed horns arranged in a hexagonal lattice pattern.

The corrugated feed horn comprises a hexagonal aperture formed by a circular-to-hexagonal transition section, and a corrugated section disposed adjacent to the circular-to-hexagonal transition section. A tapered section is disposed adjacent to the corrugated section, and an input section having an input/output port is disposed adjacent to the tapered section.

The corrugated feed horn has desirable properties of a multi-band, conical corrugated horn, including good beam pattern symmetry, low cross-polarization, and sidelobe levels, along with an increased horn aperture area. As a result, the efficiency of the corrugated feed horn is improved by transitioning from a circular to a hexagonal aperture.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
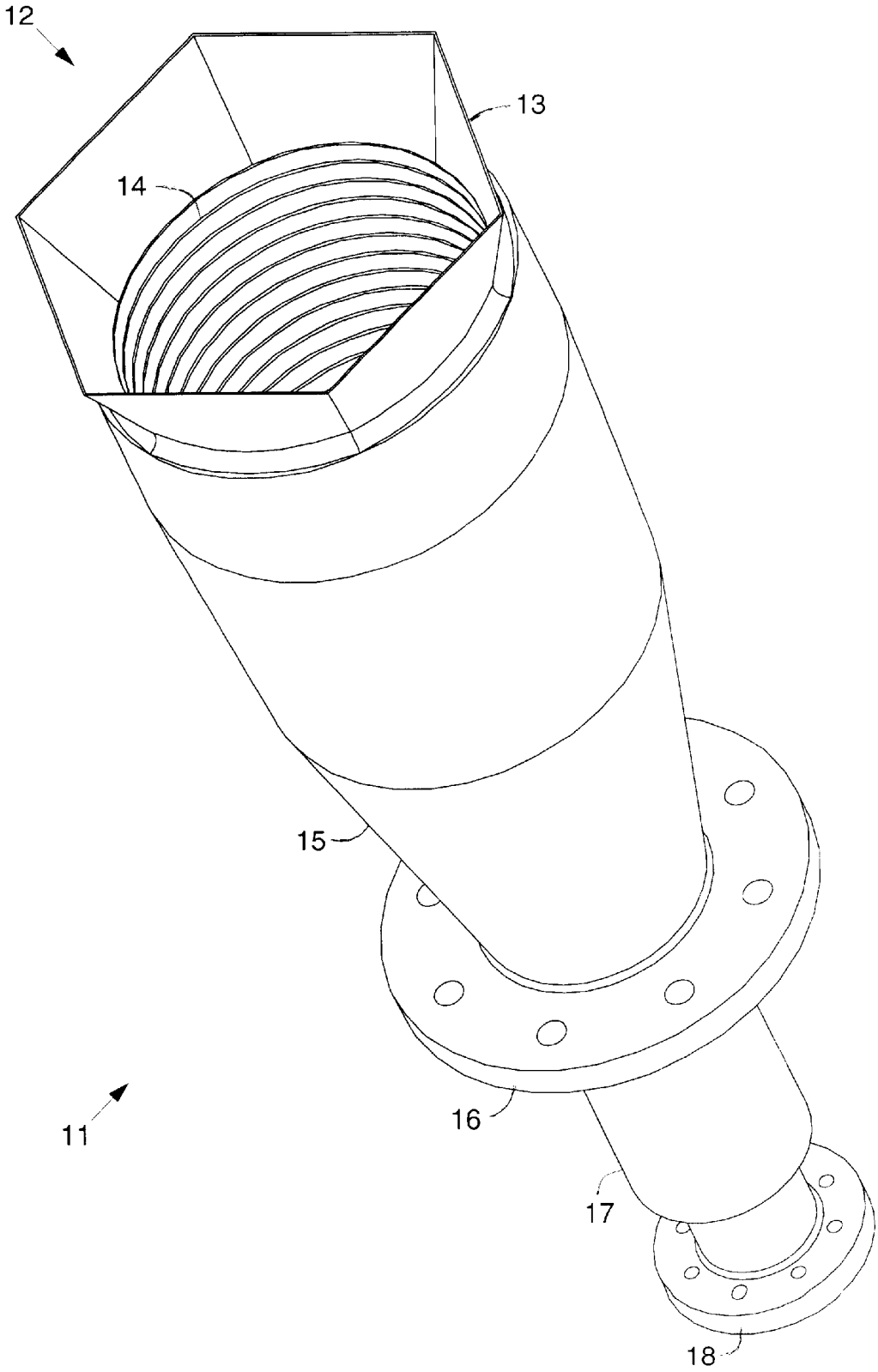
FIG. 1 illustrates an isometric view of an exemplary embodiment of a feed horn in accordance with the principles of the present invention.
Figure 2:
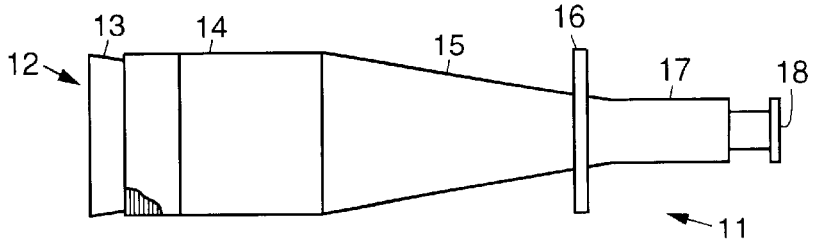
FIG. 2 illustrates a side view of the feed horn shown in FIG. 1.
Figure 3:
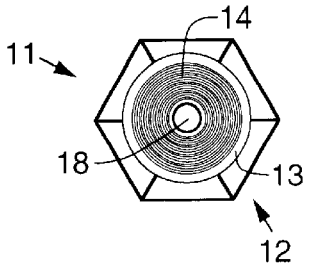
FIG. 3 illustrates a front view of the feed horn shown in FIG. 1.

Referring to the drawing figures, FIG. 1 illustrates an exemplary embodiment of a multi-band, corrugated antenna feed horn 11 in accordance with the principles of the present invention. FIGS. 2 and 3 illustrate side, and front views of the feed horn 11 shown in FIG. 1.

The feed horn 11 comprises a hexagonal aperture 12 formed by a circular-to-hexagonal transition section 13. A corrugated section 14 is disposed adjacent to the circular-to-hexagonal transition section 13. The corrugated section 14 is corrugated along its inner wall.

A tapered section 15 is disposed adjacent to the corrugated section 14. A flange 16 is disposed around the tapered section 15. An input section 17 having an input/output port 18 is disposed adjacent to the tapered section 15.

The corrugated feed horn 11 maintains desirable properties of a multi-band, conical corrugated horn, including good beam pattern symmetry, low cross-polarization, and sidelobe levels. The feed horn aperture 12 has an increased area compared to horns with circular apertures. The efficiency of the corrugated feed horn 11 is improved by transitioning to the hexagonal aperture 12.

Figure 4:
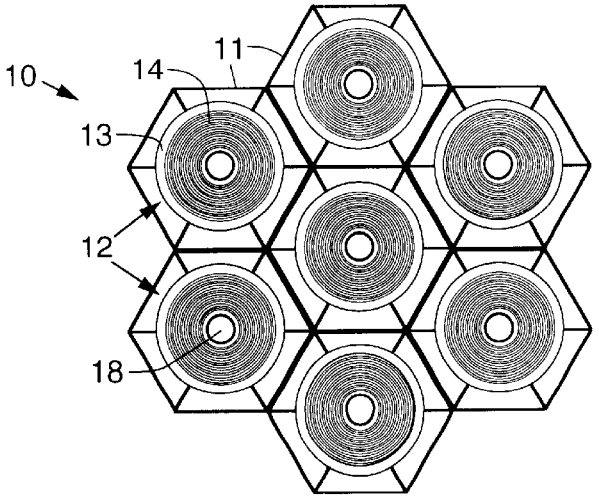
FIG. 4 illustrates an exemplary embodiment of a multi-band, corrugated feed horn array having a hexagonal lattice in accordance with the principles of the present invention employing a plurality of feed horns shown in FIGS. 1–3.

FIG. 4 illustrates an exemplary embodiment of a multi-band, corrugated feed horn array 10 in accordance with the principles of the present invention. The exemplary multi-band, corrugated feed horn array 10 comprises a plurality of feed horn 11 arranged in a hexagonal lattice pattern or structure. Seven feed horns 11 are shown in the exemplary feed horn array 10.

However, the structure of the feed horn array 10 is such that it may include an additional plurality of feed horns 11, or, a fewer number of feed horns 11. Furthermore, the size of the horn aperture 12 is increased to the maximum physically allowable hexagonal shape resulting in a feed horn array 10 having increased efficiency.

One advantage of the corrugated feed horn array 10 is that it has the benefits of a conical, corrugated, multi-band horn, including good pattern symmetry and low cross-polarization and sidelobe levels.

Thus, a multi-band, corrugated antenna feed horn having a hexagonal aperture along with an antenna array employing multiple such feed horns have been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A multi-band, antenna feed horn comprising:

a hexagonal aperture formed by a circular-to-hexagonal transition section;

a corrugated section disposed adjacent to the circular-to-hexagonal transition section;

a tapered section disposed adjacent to the corrugated section; and an input section having an input/output port disposed adjacent to the tapered section.

2. The feed horn recited in claim 1 wherein the corrugated section is corrugated along its inner wall.

3. The feed horn recited in claim 1 further comprising a mounting flange disposed around the tapered section.

4. A multi-band, antenna feed horn array comprising:

a plurality of feed horn arranged in a hexagonal lattice-like pattern wherein each feed horn comprises:

a hexagonal aperture formed by a circular-to-hexagonal transition section;

a corrugated section disposed adjacent to the circular-to-hexagonal transition section;

a tapered section disposed adjacent to the corrugated section; and an input section having an input/output port disposed adjacent to the tapered section.

5. The feed horn recited in claim 4 wherein the corrugated section is corrugated along its inner wall.

6. The feed horn recited in claim 4 wherein the feed horns further comprise a mounting flange disposed around the tapered section.

* * * * *